US008209882B2

(12) United States Patent
Leimer et al.

(10) Patent No.: US 8,209,882 B2
(45) Date of Patent: Jul. 3, 2012

(54) ACTIVELY VENTILATED SHOE

(75) Inventors: Robert Leimer, Nürnberg (DE); Timothy Kelvin Robinson, Nürnberg (DE); Frank Ingo Michel, Oberwangen (CH); Gerd Rainer Manz, Oberreichenbach (DE); Josh Robert Gordon, Herzogenaurach (DE); Tom Allen, South Yorkshire (GB); Martin Harnisch, Loechgau (DE); Joerg Blinn, Pirmasens (DE)

(73) Assignee: adidas International Marketing B.V., Amsterdam (NL)

( * ) Notice: Subject to any disclaimer, the term of this patent is extended or adjusted under 35 U.S.C. 154(b) by 751 days.

(21) Appl. No.: 12/285,951

(22) Filed: Oct. 16, 2008

(65) Prior Publication Data

US 2009/0113762 A1 May 7, 2009

(30) Foreign Application Priority Data

Oct. 23, 2007 (DE) ..... 10 2007 050 593

(51) Int. Cl.
*A43B 7/06* (2006.01)

(52) U.S. Cl. ..... 36/3 R; 36/3 B; 36/29

(58) Field of Classification Search ..... 36/3 R, 36/3 A, 3 B, 29
See application file for complete search history.

(56) References Cited

U.S. PATENT DOCUMENTS 3,048,931 A * 8/1962 Farinello ..... 36/3 R
3,273,264 A * 9/1966 Farinello, Jr. ..... 36/3 A
4,151,660 A * 5/1979 Yoshimi et al. ..... 36/10
4,782,602 A 11/1988 Lakic
5,086,576 A * 2/1992 Lamson ..... 36/131
5,230,249 A * 7/1993 Sasaki et al. ..... 73/714
5,295,313 A 3/1994 Lee
5,367,788 A * 11/1994 Chen ..... 36/3 B
5,375,345 A * 12/1994 Djuric ..... 36/3 B
5,401,039 A 3/1995 Wolf
5,495,682 A * 3/1996 Chen ..... 36/2.6
5,813,140 A * 9/1998 Obeid ..... 36/3 R
5,845,417 A * 12/1998 Reed et al. ..... 36/3 B
5,918,381 A * 7/1999 Landry ..... 36/3 B
5,929,332 A * 7/1999 Brown ..... 73/172
5,996,250 A * 12/1999 Reed et al. ..... 36/3 R
6,041,518 A * 3/2000 Polycarpe ..... 36/2.6
6,158,149 A * 12/2000 Rudy ..... 36/29
6,225,799 B1 5/2001 Gergel et al.
6,239,501 B1 * 5/2001 Komarechka ..... 290/1 R
6,594,917 B2 * 7/2003 Ricco' et al. ..... 36/3 R
6,725,571 B2 * 4/2004 Liu ..... 36/3 R (Continued)

FOREIGN PATENT DOCUMENTS

DE 200 16825 111 5/2001

*Primary Examiner* — Darnell Jayne
*Assistant Examiner* — Hiwot Tefera
(74) *Attorney, Agent, or Firm* — Sterne, Kessler, Goldstein & Fox P.L.L.C.

(57) ABSTRACT

The invention relates to an article of footwear, in particular a sports shoe, wherein the article of footwear includes a ventilation system with at least one active ventilation element arranged in a midfoot area of the article of footwear. Furthermore, the article of footwear includes at least one air channel with an inlet and an outlet which are arranged in the sole area in the interior of the article of footwear. The active ventilation element is arranged such that air is sucked from the interior of the article of footwear through the inlet and is blown into the interior of article of footwear shoe through the outlet.

40 Claims, 5 Drawing Sheets

U.S. PATENT DOCUMENTS

| | | | | |
|---|---|---|---|---|
| 6,817,112 | B2 * | 11/2004 | Berger et al. | 36/3 B |
| 6,865,825 | B2 * | 3/2005 | Bailey et al. | 36/88 |
| 7,043,857 | B2 * | 5/2006 | Meschan | 36/25 R |
| 7,204,041 | B1 * | 4/2007 | Bailey et al. | 36/29 |
| 7,210,248 | B2 | 5/2007 | Van Noy et al. | |
| 7,219,449 | B1 * | 5/2007 | Hoffberg et al. | 36/88 |
| 7,269,915 | B2 | 9/2007 | Flechsig et al. | |
| 7,328,525 | B2 * | 2/2008 | Lim | 36/3 B |
| 7,506,460 | B2 * | 3/2009 | DiBenedetto et al. | 36/132 |
| 7,913,421 | B2 * | 3/2011 | Malenotti | 36/3 B |
| 2002/0017036 | A1 * | 2/2002 | Berger et al. | 36/3 B |
| 2002/0050074 | A1 * | 5/2002 | Ricco et al. | 36/3 R |
| 2003/0009913 | A1 * | 1/2003 | Potter et al. | 36/29 |
| 2003/0145488 | A1 * | 8/2003 | Cardarelli | 36/3 R |
| 2003/0183324 | A1 * | 10/2003 | Tawney et al. | 156/145 |
| 2003/0200678 | A1 * | 10/2003 | Nishiwaki et al. | 36/28 |
| 2004/0078996 | A1 * | 4/2004 | Brooks | 36/3 B |
| 2004/0211085 | A1 * | 10/2004 | Passke et al. | 36/3 B |
| 2004/0231199 | A1 * | 11/2004 | Meschan | 36/107 |
| 2004/0237345 | A1 * | 12/2004 | Meschan | 36/28 |
| 2005/0060906 | A1 * | 3/2005 | Zimerfeld | 36/3 R |
| 2005/0132617 | A1 * | 6/2005 | Potter et al. | 36/132 |
| 2005/0235523 | A1 * | 10/2005 | Flechsig et al. | 36/3 R |
| 2006/0032083 | A1 * | 2/2006 | Lim | 36/3 B |
| 2006/0032089 | A1 * | 2/2006 | Lo | 36/29 |
| 2006/0248750 | A1 * | 11/2006 | Rosenberg | 36/29 |
| 2006/0277786 | A1 * | 12/2006 | Vattes et al. | 36/3 A |
| 2006/0277787 | A1 * | 12/2006 | Vattes et al. | 36/3 A |
| 2007/0011908 | A1 * | 1/2007 | Huang et al. | 36/3 B |
| 2007/0044345 | A1 * | 3/2007 | Yang | 36/29 |
| 2007/0094890 | A1 * | 5/2007 | Cho et al. | 36/3 B |
| 2007/0169375 | A1 * | 7/2007 | Chen et al. | 36/3 B |
| 2007/0180737 | A1 * | 8/2007 | DiBenedetto et al. | 36/132 |
| 2007/0214682 | A1 * | 9/2007 | Smotrycz | 36/3 B |
| 2007/0240333 | A1 * | 10/2007 | Le et al. | 36/30 R |
| 2008/0229623 | A1 * | 9/2008 | Ferretti | 36/3 B |

* cited by examiner

ACTIVELY VENTILATED SHOE

BACKGROUND OF THE INVENTION

1. Field of the Invention

Embodiments of the present invention generally relate to footwear, and more specifically to an actively ventilated shoe, in particular an athletic shoe.

2. Background Art

The technical development of shoes, in particular sports shoes, has advanced considerably in recent years. Modern shoe constructions are available that are adapted to compensate for the mechanical stress on a foot that arises when participating in various sporting activities. These shoe constructions provide a high degree of functionality and wearing comfort.

However, in spite of these important improvements, companies have been unsuccessful in manufacturing shoes that, in addition to providing necessary damping and support to the foot, also provide a comfortable climate for the foot. On the contrary, use of the foamed plastic materials common in modern sports shoes prevents heat and humidity from being sufficiently transported away from the foot to efficiently avoid excess heat buildup, unpleasant odor or the risk of diseases of the foot. This is particularly problematic in athletic shoes due to the increased body activity when participating in sports, which causes an increase in heat and humidity in the shoe.

For this reason different approaches have been proposed in order to achieve sufficient ventilation and fast removal of sweat.

U.S. Pat. No. 5,918,381 describes a shoe with a sole consisting of two layers. One layer contains a liquid which is moved during running and which powers a turbine. The turbine powers air-fans in the second layer of the sole that suck external air through lateral openings in the sole and pump it into the interior of the shoe.

U.S. Publication No. 2005/0060906 describes a shoe with three ventilators which pump air through lateral openings in the sole out of the shoe or into the shoe. Additionally, an air-conditioning unit pumps cool air into the shoe. The system is activated when a set temperature inside the shoe is exceeded.

In some cases, one disadvantage of these systems is that the air inlet and/or air outlet openings are arranged on the outside of the shoe. In such a configuration, there is a risk that moisture and dirt may enter the openings and thus the interior of the shoe. This can damage or even destroy the ventilation system.

In U.S. Pat. No. 6,041,518 fresh air is transported into the shoe via tubes that end at the upper edge of the laces of the shoe. However, even in this arrangement there is a danger that moisture and dirt may enter the tube. Thus, the use of covers is described to close the ends of the ventilation tubes. The diameter of the tubes is small and therefore the tubes provide a relatively small amount of ventilation.

In U.S. Pat. No. 3,273,264, an air-fan is built into the heel of a shoe. The air-fan sucks external air through an opening in the heel and pumps it into an opening in the interior midfoot area of the shoe. In some cases, one disadvantage of this approach is that the heel portion of a shoe generally experiences the highest impact forces during the gait cycle, and these forces can interfere with the operation of the ventilation system. In addition, because impact forces are at their peak in the heel, the heel portion of a shoe is generally provided with a significant amount of cushioning. Because the ventilation system described in U.S. Pat. No. 3,273,264 occupies a substantial volume of the heel, the system has the undesirable effect of reducing the amount of cushioning material that can be placed in the heel.

Further, U.S. Publication No. 2005/0235523 describes a shoe with a micro fan which is arranged on the outside of a shoe. In at least one embodiment, the fan pumps air into the shoe through small holes in the fabric of the shoe. A thermal switch controls operation of the fan. However, the fan can be easily damaged due to its positioning on the toe or exterior side of the shoe. There is also a danger that moisture and dirt will be sucked in by the fan. Furthermore, in this arrangement no fresh air is transported to the underside of the foot, which is where the most moisture collects and most heat is generated.

U.S. Pat. No. 6,865,825 relates to ergonomic systems with adapted surfaces and temperature control. The described systems of actuators and sensors are directed to medical therapy and do not provide solutions for a controlled ventilation of shoes.

German Utility model DE 200 16 825 U1 relates to a shoe-sock combination wherein the shoe comprises at least one climate zone which enables air exchange, and wherein the sock comprises at least one climate zone which enables air exchange. The arrangement of the climate zones of the shoe and the climate zones of the sock are harmonized with respect to each other.

The above-described approaches for ventilation suffer from several disadvantages, including lack of protection from moisture and dirt, insufficient air circulation inside the shoe, and insufficient cushioning in the heel area. Furthermore, the possibilities for controlling ventilation are limited, since a simple temperature control does not satisfy the complex and variable requirements for maintaining a comfortable climate in a shoe. Several of the shoes described above can be time-consuming to manufacture because the components of the ventilation systems are distributed in different locations of the shoe and therefore add steps to the manufacturing process. Alternately, the ventilation system is mounted on the outside of the shoe so that the system is not protected from the elements.

Thus, there is a need for an article of footwear, in particular a sports shoe, which overcomes at least some of the explained disadvantages of the prior art by, for example, providing effective ventilation to the interior of a shoe, satisfying the complex requirements of maintaining a comfortable foot climate, protecting the interior of the shoe and the ventilation system against moisture and dirt, and maintaining a streamlined manufacturing process.

BRIEF SUMMARY OF THE INVENTION

Embodiments of the present invention may solve one or more of the above stated problems by providing an article of footwear that comprises a ventilation system with at least one active ventilation element arranged in the midfoot area and at least one air channel. The air channel has an inlet and an outlet which is arranged in the sole area in the interior of the shoe. The active ventilation element is arranged such that air is sucked from the interior of the shoe through the inlet and is released again to the interior of the shoe through the outlet.

Arranging the active ventilation element in the midfoot area may be advantageous since this area experiences neither the compression forces that occur when the shoe hits the ground nor the deformations in the forefoot area when the heel lifts from the ground. It may have the further advantage of leaving sufficient volume in the heel area for materials which cushion the heel when the shoe hits the ground. Further, arranging the active ventilation element in the midfoot area provides effective ventilation of the shoe by facilitating an air channel from the midfoot area to the forefoot area. These two areas are particularly advantageous for ventilation since the foot exerts a lower pressure to the sole in these areas of the shoe and thereby a more efficient exchange of air is provided.

This arrangement of the inlet and the outlet of the air channel in the interior of the shoe provides improved protection against moisture and dirt from the outside since they cannot enter the air channel or the interior of the shoe. A shoe with such ventilation can also be used during running and hiking cross-country, and even in the rain and when snow skiing without causing wet feet or a failure of the ventilation system.

The system provides effective ventilation to the interior of the shoe because the active ventilation element creates an air stream inside the shoe. The air stream is in fluid communication with external ambient air through materials in the upper and in the shoe entry that are permeable to air. This provides effective ventilation to the foot because the inlet and the outlet of the air channel are located in the sole area, thereby introducing air to the bottom of the foot where ventilation is most needed.

In one embodiment, the entry of the air channel is arranged in the midfoot area and the outlet of the air channel is arranged in the forefoot area. This arrangement causes the active ventilation element to create an air stream inside the shoe wherein air is sucked from the midfoot area, transported through the air channel, and then blown back into the forefoot area. Because the midfoot area of the foot exerts considerably lower pressure on the sole than, for example, the heel or the ball of the foot, the midfoot area of the shoe is an ideal location from which to pull air from the shoe interior. Pulling air from the midfoot area causes low pressure in that portion of the shoe. Air from the upper part of the shoe then streams into the low pressure area, and since the upper part of the shoe may comprise openings to external air, as described above, external air is introduced to the midfoot and the air channel.

The active ventilation element pumps air through the outlet of the air channel located in the forefoot area, preferably under the toes, and back into the interior of the shoe. There is a comparatively low pressure under the toes so that the air can exit from the air channel. High pressure arises over the outlet of the air channel which presses the air further into the upper part of the shoe. This leads again to an exchange with external air as described above, for example via the upper which is constructed of materials that are permeable to air, and also via the shoe entry. As a result, fluid communication between the air channel and external air is generated without the inlet or outlet of the air channel being arranged on the outside of the shoe.

In one embodiment, the ventilation system is arranged in at least one intermediate sole of the shoe and the air channel comprises one or more recesses in an intermediate sole.

This arrangement of the ventilation system and the air channel in an intermediate sole has several advantages. On the one hand, manufacturing may be simplified since this arrangement enables modular manufacturing and avoids impacting other steps of the manufacture. In addition, the intermediate sole may provide good protection for the components of the ventilation system.

Recesses to house the air channel may be arranged in the midfoot area and/or forefoot area of the intermediate sole. With this configuration, air can be guided from the midfoot area to the forefoot area. In some embodiments, these locations may be preferred because in both these areas the foot exerts a lower pressure to the sole than in other areas, which facilitates ventilation.

In one embodiment, the recesses in the intermediate sole are covered by a plastic element which comprises openings at its two ends. In one embodiment, the plastic element is manufactured from fiber-enforced polyamide, and more preferably from 20% fiber-enforced polyamide.

In this way, the air channel can be set up as a simple indentation in the intermediate sole which is closed by a cover with openings. Therefore, the high effort required to manufacture cavities or holes to function as air channels and/or the use of tubes is avoided.

In one embodiment, the plastic element comprises a ribbing with indentations and at least two projections on the upper side of the plastic element. Both the indentations and the projections of the ribbing comprise openings. The indentations and the projections form lower and upper levels of the plastic element. This ensures that when the shoe is worn at least the opening in the indentations (lower level) remains uncovered by the sole of the foot of the wearer. The sole of the foot of the wearer rests on the projections of the ribbing of the plastic elements, i.e. on the upper level, so that the air stream is not interrupted due to being covered by the foot. Preferably, the ventilation system can be accessed from the side of the intermediate sole. This enables an exchange of components of the ventilation system, for example, a battery for operating the active ventilation element. The opening in the intermediate sole can be closed by a seal in order to prevent the entry of moisture and dirt.

In a further embodiment, the ventilation system comprises at least one control unit with a CPU and one or more sensors. The assembly and operation of the control unit depends on the design and the specific arrangement of the active ventilation element controlled by the control unit. The sensors may comprise at least one temperature sensor and/or at least one moisture sensor. Unlike the prior art, which shows a simple temperature switch, a CPU-controlled control unit is capable of registering complex situations with different sensors and reacting with corresponding adjustments to the ventilation system.

In one embodiment, the sensors determine a usage state of the shoe. This enables corresponding control of the ventilation system, depending on whether the shoe is worn and/or whether the user of the shoe is moving or not.

In one embodiment of the shoe, the control unit is arranged between two layers of the intermediate sole. Due to the high mechanical load of the sole during walking or running, this arrangement is particularly advantageous and provides protection for the control unit.

In one embodiment, the shoe may comprise an input device for the control unit. The control unit has an automatic mode and/or a manual mode. Even in the automatic mode, the control system can be adjusted manually. Preferably, the input device is arranged in the forward portion of the heel area of the shoe.

Such an input device contributes significantly to achieving a desired foot climate, since it enables at any time an adjustment of the control of the ventilation system to the wishes of the user. The exclusively automatic control described in the prior art cannot accommodate manual adjustment and therefore offers less climate customization.

In an embodiment of the present invention, the input device controls a control unit of another shoe, for example, wirelessly by transmitting corresponding control signals from the first shoe to the other shoe. This avoids the need to input user-specific adjustments for the other shoe.

In a further embodiment, the control unit is controlled by a portable electronic device. Since runners or walkers frequently carry such a device, the ventilation system can be controlled in a very simple and comfortable way. It also may be preferred that the control unit, the input device, and/or the portable electronic device store user-specific adjustments.

In one embodiment, a power source of the ventilation system is charged by a power jack in the shoe. Furthermore, the ventilation can be supplied with energy by transforming mechanical power into electrical power. Corresponding devices are known in the prior art. If mechanically generated power is used, it is not otherwise necessary to charge or exchange the battery.

Further developments form the subject of further dependent patent claims.

BRIEF DESCRIPTION OF THE DRAWINGS/FIGURES

In the following, aspects of the present invention are explained in more detail with reference to the accompanying drawings. These figures show:

Figure 5A:
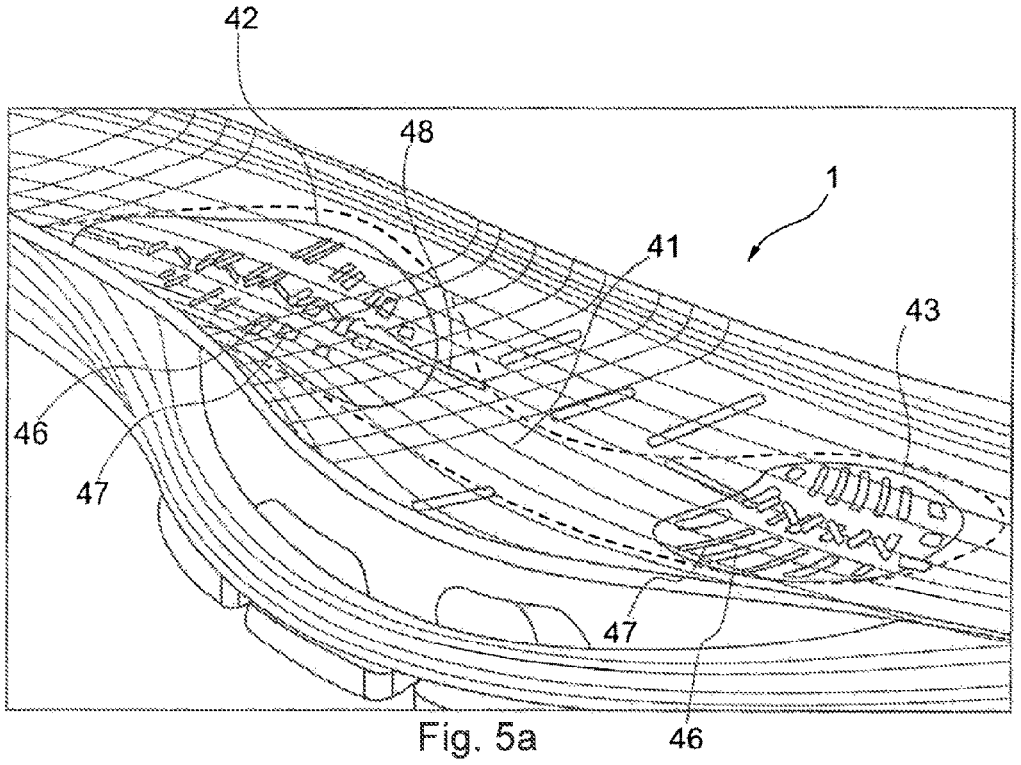
Figure 5B:
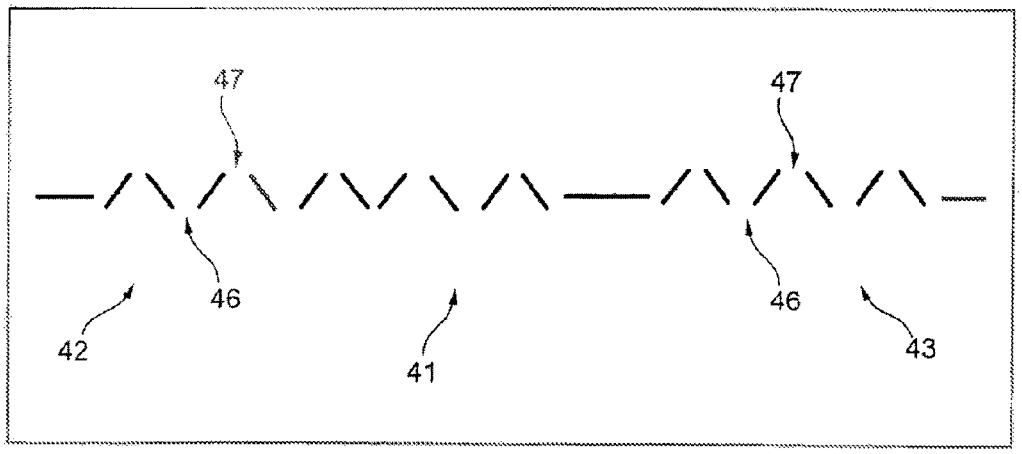
Figure 6:
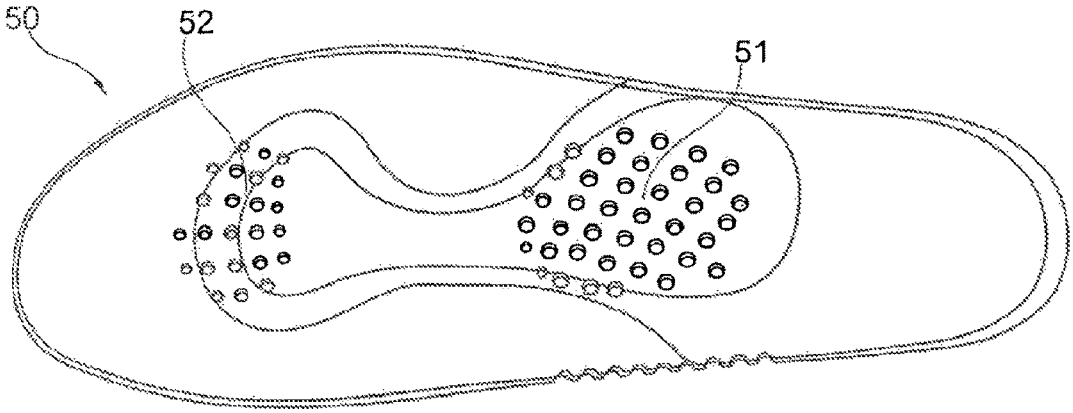
Figure 7:
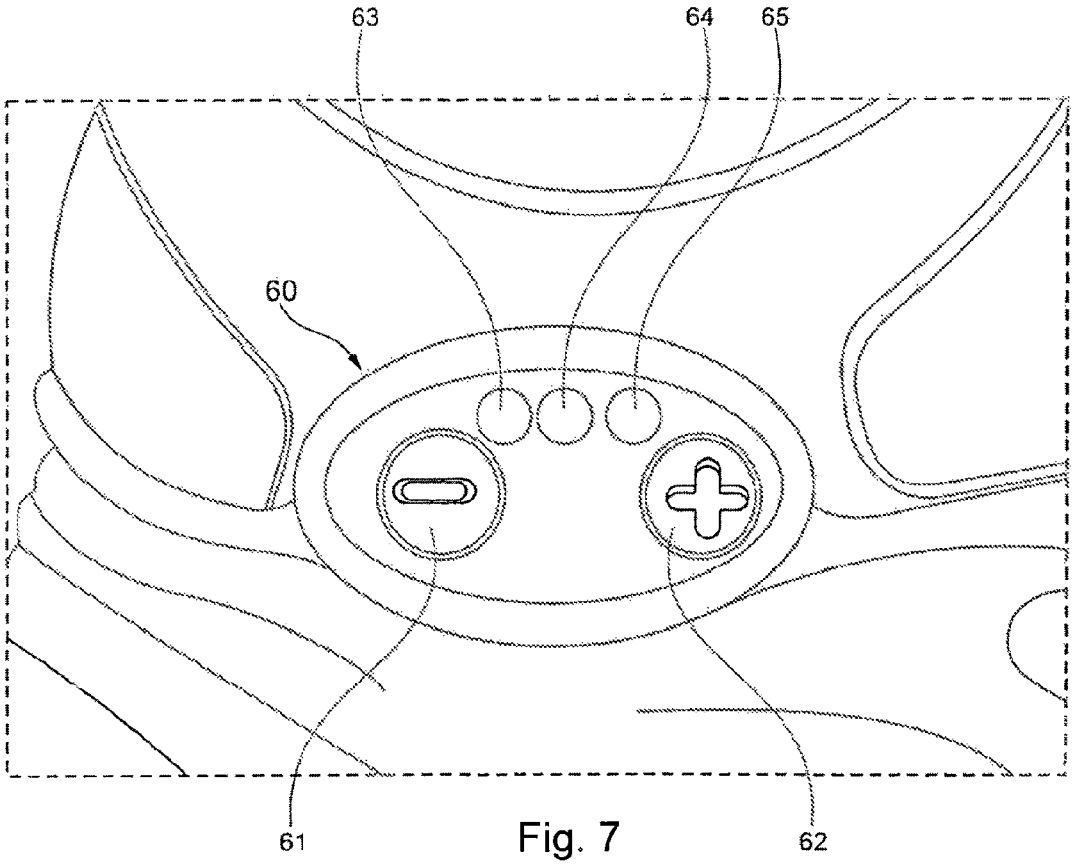
Figure 8:
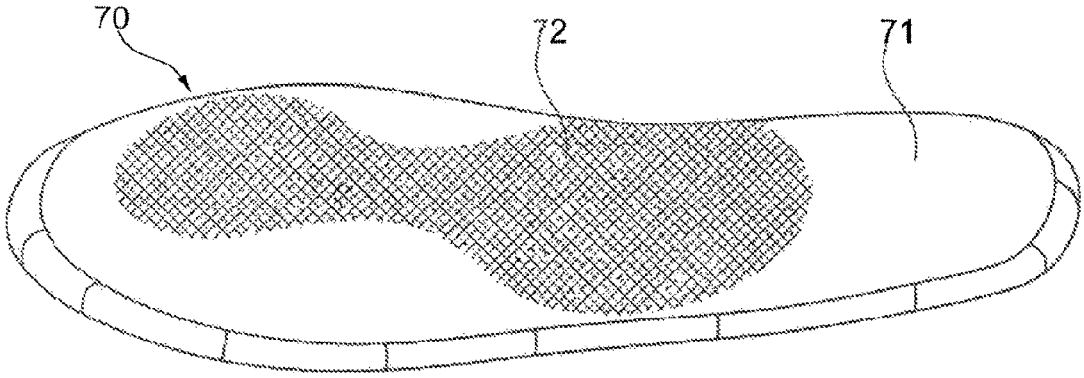

FIG. 5*a* is a perspective view of the plastic element with ribbing according to an embodiment of the present invention;

FIG. 5*b* is a schematic cross-section of the plastic element with ribbing according to an embodiment of the present invention;

FIG. 6 is a top view of an insole according to an embodiment of the present invention;

FIG. 7 is a side view of an input device for a control unit of the ventilation system according to an embodiment of the present invention; and FIG. 8 is a sock according to an embodiment of the present invention.

DETAILED DESCRIPTION OF THE INVENTION

The present invention is now described with references to the Figures. As follows, embodiments of the present invention of a running shoe are described in more detail. While specific configurations and arrangements can be used without departing from the spirit and scope of the invention, it will be apparent to a person skilled in the relevant art that this invention can also be employed in other applications. The following examples are illustrative, but not limiting, of the structure and methods of the present invention. Other suitable modifications and adaptations of the variety of conditions and parameters normally encountered in the field, and which would be apparent to those skilled in the art, are within the spirit and scope of the invention.

It will be appreciated that the present invention is not limited to running shoes or sports shoes. Rather, embodiments of the present invention may be used in any suitable article of footwear, including, but not limited to, shoes, sandals, boots, and the like, and may be used during any activity where regulation of foot climate is desired, for example during running, walking, hiking, skiing or cross-country skiing. The shoe design for ventilation described in the following may be particularly advantageous for shoes which are exposed to moisture in the sole area during use.

Figure 1:
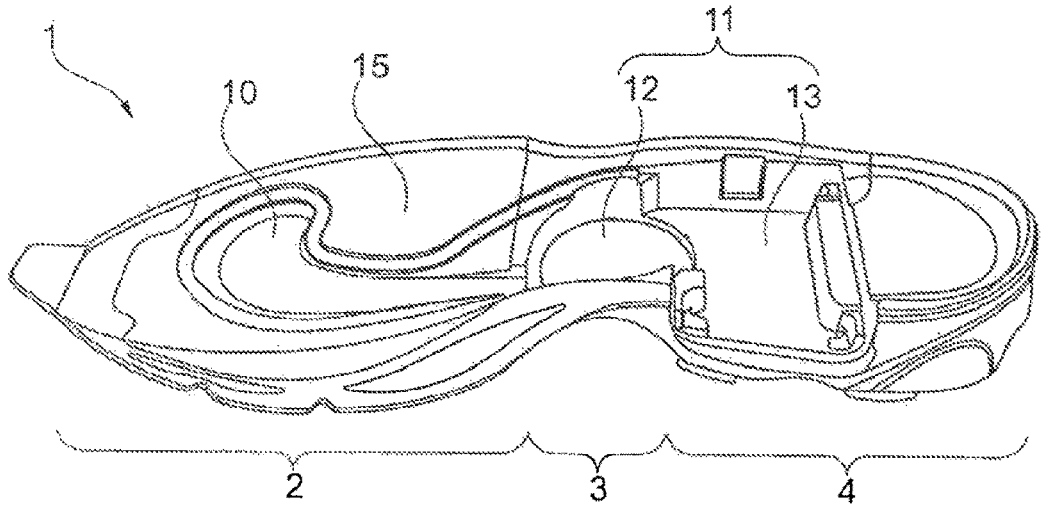
FIG. 1 is a perspective view of an intermediate sole of a shoe according to an embodiment of the present invention.

FIG. 1 shows a perspective view of an intermediate sole 1 of a shoe according to an embodiment of the present invention. A recess 10 for an air channel extends from midfoot area 3 to the forefoot area 2. The dimensions of forefoot area 2, midfoot area 3, and heel area 4 shown in FIG. 1 (and in FIG. 4) are only exemplary and may vary. Intermediate sole 1 may comprise any sole layer above the outsole of the shoe.

In other embodiments, the air channel comprises several recesses or connects other areas of the foot. For example, a recess may connect forefoot area 2 and heel area 4 or may connect midfoot area 3 and heel area 4. Several recesses may connect the same areas, or they may connect different areas of the shoe. A recess can also branch. The shape of recess 10 for the air channel shown in FIG. 1 is exemplary only and may vary to a great extent.

As shown in FIG. 1, another recess 11 has a first area 12 and a second area 13 for receiving a ventilation system. The first area 12 is arranged in midfoot area 3 and serves to receive an active ventilation element. In the embodiment shown in FIG. 1, the first area 12 is shaped as a cylinder. Alternately, first area 12 could be formed in other shapes. In one embodiment, this cylinder is sealed at its bottom side with a flexible and transparent plastic material (not shown) which partially extends over the bottom side of the intermediate sole 1. This allows observation of the function of the active ventilation element.

In the embodiment shown in FIG. 1, the first area 12 occupies more than half of the width of the intermediate sole 1, in order to provide space for a strong active ventilation element that can deliver a correspondingly strong air stream for effectively ventilating the shoe. In other embodiments, the first area 12 can be smaller than half of the width of the intermediate sole 1.

The second area 13 of the recess 11 is arranged in the front part of the heel area 4 and serves to receive further components of the ventilation system. Arrangement in the front part of the heel area 4 has the advantage that the loads and deformations during running are smaller than in the rear part of the heel area 4.

In alternative embodiments, the first area 12 and the second area 13 of the recess 11 can be arranged in other parts of the intermediate sole 1. Both areas may also be separated, i.e. disconnected.

Figure 2:
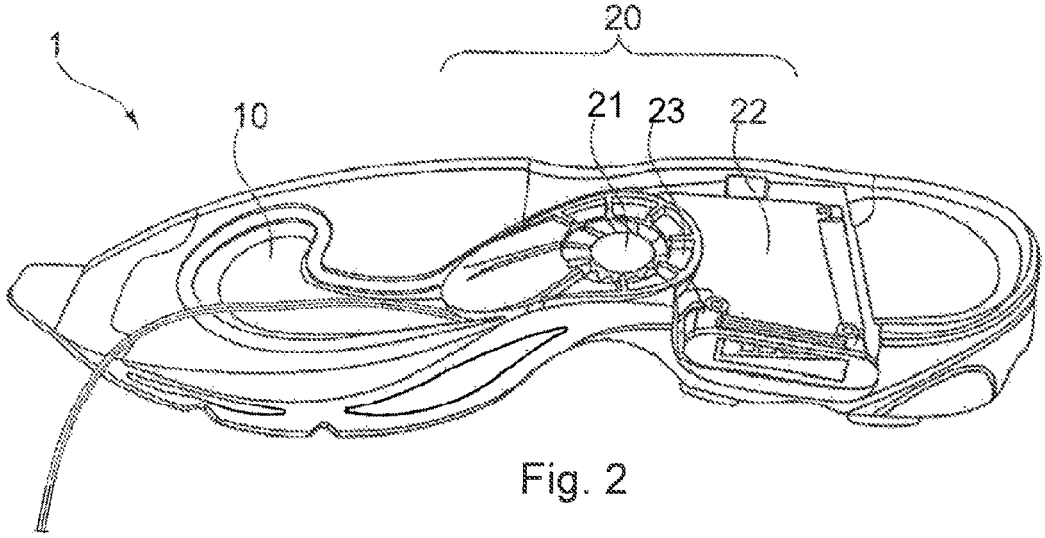
FIG. 2 is a further perspective view of the intermediate sole of FIG. 1 with a ventilation system according to an embodiment of the present invention.

FIG. 2 shows a further perspective view of the intermediate sole of FIG. 1. A ventilation system 20 is arranged in the recess 11 shown in FIG. 1. The ventilation system comprises housing 23, an active ventilation element 21 consisting of an air-fan or ventilator, a battery 22, and a control unit (not shown) with a CPU, one or more sensors, and/or electronic circuitry. The ventilator 21 can be operated at several speeds which can be adjusted smoothly or in steps. The latest ventilators can be operated with six different speeds of the air-fan, for example. Ventilator 21 can be a conventional ventilator with an air-fan or can be based on other mechanical principles for the movement of air.

In the embodiment shown in FIG. 2, the ventilator 21 is arranged in the midfoot area 3. Alternatively, the ventilator 21 can also be arranged in other areas of the sole, for example in the heel area 4. However, arranging the ventilator 21 in midfoot area 3 may be advantageous compared to the heel area 4. If the ventilator 21 was arranged in the heel area 4, it would be exposed to strong compression forces when the shoe hits the ground. Further, there may be limited volume available for materials which cushion the compression forces. Arranging the ventilator 21 in the midfoot area 3 may also be advantageous compared to the forefoot area 2. This is because the forefoot area 2 is strongly deformed when the heel leaves the ground during the gait cycle.

The sensors included in the central unit may include a temperature sensor, a moisture sensor, a pressure sensor, a capacitive proximity sensor and/or further sensors. Preferably, the temperature sensor is located close to the arch of the foot. An example of a moisture sensor is described in U.S. Pat. No. 6,817,112 (also published as German Patent DE 100 36 100), the disclosure of which is incorporated herein by reference thereto. Several sensors of the same type may be used. For example, one temperature sensor may measure the temperature of the external air and another may measure the temperature inside the shoe. Various measuring results are then combined and evaluated by the CPU to control the ventilator 21.

In applications where heating the shoe is desired, for example, during winter sports or hiking or camping, the ventilation system may additionally be equipped with a heating element which can be controlled with the control unit using the described sensors. The ventilation system may also be equipped with a cooling element for cooling the shoe. The cooling element could also be controlled by the described control unit and sensors.

The sensors can also be used to determine a usage state of the shoe. For example, sensors can be used to determine whether the runner is moving, whether he is in a passive phase (through use of an acceleration sensor, such as, for example, an accelerometer) and/or whether the shoe is being worn (pressure sensor or capacitive proximity switch). Determining the usage state of the shoe enables the ventilation system to be adjusted appropriately. For example, tests have shown that during passive phases temperature and moisture inside the shoe increase significantly. This increase can be avoided or at least reduced if the air stream inside the shoe is increased at the beginning of the passive phase. The difference between a running phase and a passive phase can be determined using the above-mentioned pressure sensor, for example by measuring the time variation of the pressure in a sole. The passive phase is characterized by significantly lower and/or irregular pressure changes as compared to the running phase.

Figure 3:
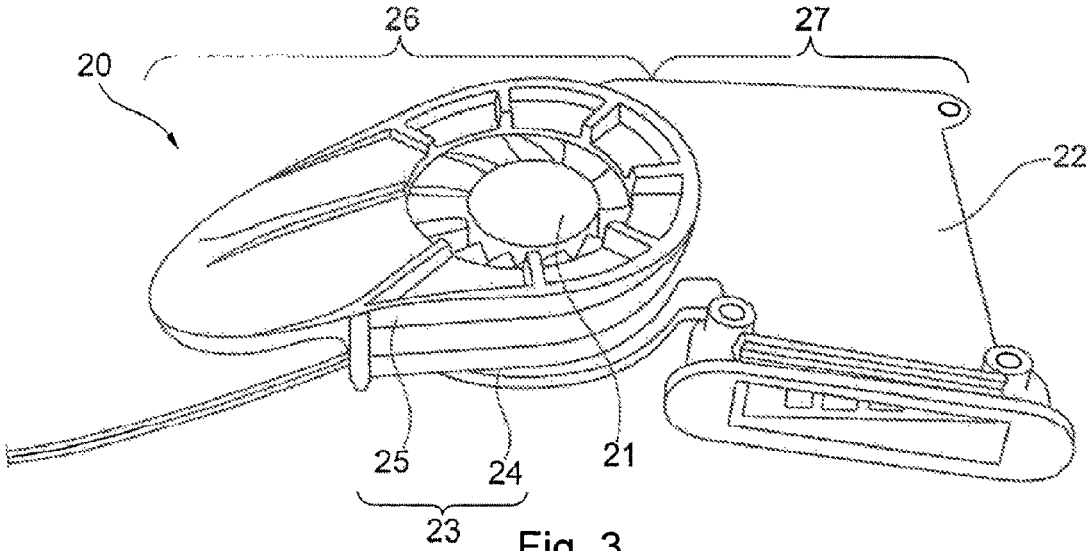
FIG. 3 is a perspective view of a ventilation system according to an embodiment of the present invention.

FIG. 3 shows a perspective view of the ventilation system 20 according to an embodiment of the present invention. Housing 23, active ventilation element 21 and battery 22 are shown. The housing 23 of ventilation system 20 comprises a lower part 24 and an upper part 25 which may simplify manufacture of housing 23.

The battery 22 can be a rechargeable battery which can be charged by a common charger, for example a battery and a charger of a mobile phone. Charging can be done via a power jack in the sole which is covered by a movable insole of the shoe. The power jack can also be located in other parts of the shoe, for example on the outside of the sole.

In further embodiments, ventilation system 20 can be supplied with power by transforming mechanical power into electrical power. Examples are piezo-electric converters or turbines driven by liquids which are moved by movement of the wearer. The generated power may charge the battery 22 or may supply the ventilation system 20 directly with power. In the latter case, no battery is needed. Generation of the power for ventilation system 20 can also be achieved using other power sources, for example, fuel cells and/or solar cells on the shoe and/or a garment of the wearer of the shoe.

As shown in FIG. 3, the housing 23 is at least partially manufactured from rigid plastic, so that the components of the ventilation system are protected. This construction increases the stability of the intermediate sole 1, which otherwise would be reduced by the recesses 10 and 11 shown in FIG. 1. In addition, use of metal and/or composite material elements may contribute to an increased stability.

In one embodiment, parts of the housing 23 may be manufactured from rigid plastic, and other parts manufactured from flexible plastic, in order to achieve desired rigidity or flexibility in a particular area of the shoe. For example, the front part 26 and the rear part 27 of the housing 23 may be connected by a flexible material or by a joint, in order to achieve a corresponding elasticity of the housing 23 during deformation of the intermediate sole 1.

Different materials may be used in the intermediate sole in order to balance the elasticity of the intermediate sole 1 which is modified by the recesses 10, 11. For example, in FIG. 1, an area 15 partially encompasses the recess 10 and is manufactured from a less elastic material than other areas of intermediate sole 1.

Although the ventilation system 20 in FIG. 3 consists of one part, it may alternatively consist of several separated parts which are located in different recesses of the intermediate sole 1 or in other parts of the shoe, as described above in connection with FIG. 1.

Figure 4:
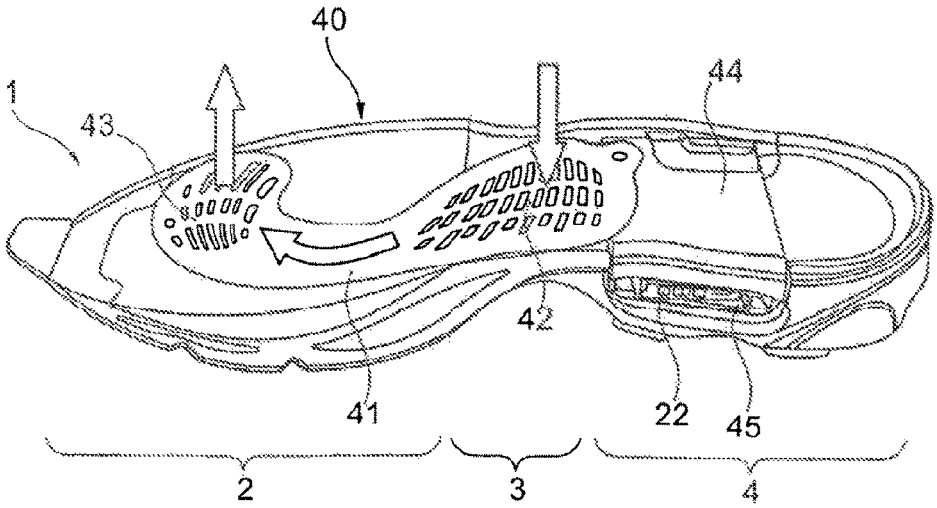
FIG. 4 is a further perspective view of the intermediate sole of FIG. 1 with a plastic element and a cover according to an embodiment of the present invention.

FIG. 4 shows another perspective view of the intermediate sole 1 of FIG. 1. A plastic covering element 41 has a first opening 42 and a second opening 43. In one embodiment, the first opening 42 and the second opening 43 may each comprise multiple openings, as shown in FIG. 4. Alternatively, the first opening 42 and/or the second opening 43 may comprise a single opening. The plastic element 41 covers the recesses 10 and 12 shown in FIG. 1. Preferably, the plastic element 41 is manufactured from fiber-enforced polyamide, and most preferably from 20% fiber-enforced polyamide. It is contemplated that in some embodiments other suitable non-plastic materials may be used, including, but not limited to, metal and hard rubber. The plastic element 41 is sufficiently flexible so that it does not impede rolling-off during the gait cycle. On the other hand, it is sufficiently rigid so that the material does not collapse and openings 42 and 43 (which are described below in more detail in connection with FIG. 6) remain open and enable an unimpeded air stream.

One or more air channels 40 are formed by the plastic element 41 together with the recesses 10 and 12. In order to create an air stream, the ventilator 21 is arranged under the plastic element 41 in the midfoot area 3 such that it sucks air through opening 42 and blows it out again through opening 43, as indicated by the arrows in FIG. 4. Therefore, in the insole 50 shown in FIG. 6, an inlet 51 is located over the opening 42, and an outlet 52 is located over the opening 43. In one embodiment, the inlet 51 and the outlet 52 may each comprise multiple openings, as shown in FIG. 6. Alternatively, the inlet 51 and/or the outlet 52 may comprise a single opening.

Inlet 51 and outlet 52 form the inlet and outlet of the air channel 40. This leads to an air stream inside the shoe, as described in more detail below. Arranging the ventilator 21 in the midfoot area 3 is particularly advantageous since this enables a compact form of the air channel from the midfoot area 3 to the forefoot area 2 and does not require additional volume in the heel area 4 which may detract from cushioning.

In this way the air channel 40 is formed as a simple recess in the intermediate sole 1 which is closed on its upper side but has openings 42 and 43 in the plastic element 41. The complex manufacture of cavities or holes as air channels or the use of tubes is therefore avoided.

FIG. 5*a* shows a perspective view of the intermediate sole 1 with plastic element 41 and openings 42 and 43 according to an embodiment of the present invention. As can be recognized, the plastic element 41 comprises a ribbing in the area of the openings 42 and 43 with indentations and at least two projections on the upper side of the plastic element. Both the indentations 46 and the projections 47 of the ribbing are provided with vents. The indentations 46 and the projections 47 form lower and upper levels of the plastic element 41. This ensures that during wearing of the shoe at least the vents in the indentations 46 (lower level) remain uncovered by the insole of the footwear or the sole of the foot of the wearer. The sole of the foot of the wearer or the insole of the footwear rests on the projections 47 of the ribbing of the plastic elements, i.e. on the upper level, so that the air stream is not interrupted.

FIG. 5*b* shows a schematic cross-section of the plastic element 41 with ribbing along line 48 in FIG. 5*a*. This schematic cross-section emphasizes the indentations 46 and the projections 47 of the ribbing. It can also be recognized that the indentations 46 form a lower level with vents and that the projections 47 form an upper level with vents, as described above.

It is further advantageous to wear a sock with a particular fabric together with the shoe according to the invention, as described below with respect to FIG. 8. The particular fabric is provided essentially in the area of the inlet 42 and the outlet 43 of the air channel 40 for improved permeability of the air stream.

As a result, the active ventilation element 21 creates an air stream inside the shoe, wherein at first air is sucked from the midfoot area 3 through the inlet 51 and then pumped into the air channel 40, as indicated in FIG. 4 by arrows. Since the foot in midfoot area 3 exerts a significantly lower pressure to the sole than in the heel area 4 or under the ball of the foot, the midfoot area 3 is advantageous for sucking in air. The sucking causes low pressure above the inlet 51 inside the shoe, so that air naturally streams from the upper part of the shoe to the lower part to compensate for the low air pressure. This leads to an exchange with external air via materials permeable to air in the upper and via the shoe entry.

The active ventilation element 21 then pumps air through outlet 52 of the air channel 40 located in forefoot area 2, preferably under the toes, and back into the interior of the shoe. Also under the toes there is a comparatively low pressure, so that the air can exit. Above outlet 52 of air channel 40 high pressure is created which presses the air further into the upper part of the shoe. Again, this leads to an exchange with external air via materials permeable to air in the upper and via the shoe entry, as described above.

This air stream inside the shoe creates an exchange with external air without locating inlet 51 or outlet 52 of air channel 40 on the outside of the shoe. In this way, the shoe is significantly better protected against intrusion of moisture and dirt which could also damage the ventilation system 20.

In further embodiments, modified designs of recess 10 (see FIG. 1) create other air channels and other air streams. For example, an air stream from heel area 4 to forefoot area 2 can be created which is also conceivable in the reverse direction from forefoot area 2 to heel area 4. Several air streams can also be created, for example a first air stream from midfoot area 3 to forefoot area 2 and a second air stream from midfoot area 3 to heel area 4.

Further, using the sensors described above, particularly adapted air streams can be created depending on the measured temperature and moisture and on the usage state of the shoe. For example, it can be taken into account that there are different pressures inside the shoe during the gait cycle, i.e. during ground contact and in the flight phase, which can be exploited by corresponding air streams of ventilation system 20.

More in detail, in the unloaded state during the flight phase the foot exerts a significantly lower pressure to the sole than during ground contact. Therefore, a more effective ventilation of the lower side of the foot is possible in this phase. This could be exploited by running the ventilator 21 during the flight phase with a high speed and during ground contact with a low speed. In this way, the power usage of the ventilator 21 could be substantially reduced.

The corresponding phase of the gait cycle can be determined by the above mentioned pressure sensor or acceleration sensor, for example. The beginning of the ground contact can be determined by an increase of the pressure in heel area 4, and the beginning of the flight phase can be determined by a reduction of the pressure in forefoot area 2. To this end, pressure sensors can be located in various areas of the sole. In particular, a pressure sensor can also be located inside air channel 40.

In a further embodiment a phase of the gait cycle or a passive phase is determined using the acceleration sensor mentioned above. Using this sensor, hitting the ground can be determined when the acceleration goes back to approximately zero after having reached a maximum. Accordingly, the start of the flight phase can be determined when afterwards a significant increase in acceleration is detected. A passive phase is characterized by a prolonged minimal acceleration. To determine the phase of the gait cycle or a passive phase it is also possible to combine the measured values of several sensors, for example a combination of pressure sensor and acceleration sensor.

Further functions can be realized by using a capacitive proximity sensor or proximity switch. For example, the usage state of the shoe can be determined. Such sensors are based on known physical principles and provide a varying electric signal when an object comes closer to the sensor or moves away from it. The capacity of a capacitor is changed by the electric properties of the object (dielectric). For example, a change in the electric properties of the object may occur when the user grabs the shoe or puts it on.

For example, by using such a proximity sensor it can be determined whether the person is in the direct proximity of the shoe. Another proximity sensor can be used to determine whether the shoe is already put on. Due to these determinations the ventilation system may be switched on automatically, for example. In addition, proximity switches can be used as switches for an input device for controlling the shoe, as described below in connection with FIG. 7.

Apart from this combination of different proximity sensors and/or proximity switches, it is also possible to realize different functions by using a single proximity sensor/proximity switch. For example, by using an appropriate electric field it could be determined whether the person is located near the shoe. The proximity sensor/switch could then automatically be changed so that it operates as a switch for the input device. Alternatively, the proximity sensor/switch could be changed in order to determine whether the shoe is already being worn before it is changed to become a switch for the input device.

It is also possible to use a proximity sensor to determine the distance of the shoe to the ground and consequently the respective phase of the gait cycle, as described above in connection with an acceleration sensor.

Referring again to FIG. 4, a cover 44 can be utilized to protect the components of the control unit (not visible) and battery 22 located under the cover 44. The cover 44 is preferably manufactured from the same elastic plastic as the neighboring areas of the intermediate sole 1. The cover 44 creates a continuous surface in heel area 4 of intermediate sole 1. In midfoot area 3 and the forefoot area 2, such a continuous surface is created by plastic element 41 whose semi-rigidity contributes to the elasticity of intermediate sole 1.

In one embodiment, as shown in FIG. 4, a lateral opening 45 may be disposed in the intermediate sole 1 such that the battery 22 can be accessed via the lateral opening 45. This enables, for example, an exchange of battery 22 or of other components of ventilation system 20. Taking components out is supported by appropriate mechanical means such as a spring. Opening 45 is closed by a fastener (not shown) which is sealed so that intrusion of moisture and dirt is avoided. It is contemplated that an opening may be provided on the medial side of the intermediate sole in addition to, or instead of, the lateral opening 45.

FIG. 7 is a side view of an input device for the control unit of ventilation system 20 according to an embodiment of the present invention. The input device may include a left button 61, a right button 62, a first light emission diode (LED) 63, a second LED 64, and a third LED 65. The input device may include indicia for facilitating operation by the user. For example, in one embodiment the left button 61 has a "–" sign and the right button 62 has a "+" sign to indicate means for decreasing and increasing the level of ventilation, respectively. Furthermore, in one embodiment the input device 60 is arranged in the heel area of a shoe between sole and upper. In other embodiments, input device 60 can be located in other parts of the shoe, for example at the sole or at the upper. The input device 60 is protected against intrusion of moisture and dirt by appropriate seals.

The input device serves to adjust the control unit of ventilation system 20. The control unit comprises an automatic and a manual mode. Preferably, the control unit can also be adjusted manually even when in automatic mode. The handling of the input device 60 is described in more detail below.

In one embodiment, the ventilation system 20 is switched on by simultaneously pressing left button 61 and right button 62 of input device 60. In response, LEDs 63, 64, and 65 each flash once from left to right in FIG. 7. In an alternative embodiment, ventilation system 20 is automatically switched on when the shoe is put on, as described above in connection with proximity sensors/switches.

When ventilation system 20 is switched on, the air stream can be reduced by pressing left button 61, and the air stream can be increased by pressing the right button 62. The corresponding levels of ventilation are indicated by the LEDs 63, 64, and 65. For example, a minimal air stream can be indicated by illumination of only left LED 63 and a maximal air stream can be indicated by illuminating all LEDs 63, 64, and 65. This allows manual adjustment of temperature and moisture inside the shoe.

By pressing again simultaneously on left button 61 and right button 62, ventilation system 20 is switched to the automatic mode. In this mode, the air stream inside the shoe is automatically controlled by the control unit of the ventilation system 20, for example based on temperature and moisture inside the shoe. Further possibilities for control are described above.

In the automatic mode it is further possible to reduce the air stream by pressing left button 61 and increasing the air stream by pressing right button 62, i.e. a manual adjustment in the automatic mode. These adjustments are stored and are available during further use of the shoe without having to input them again.

For example, a range of temperatures can be shifted to lower or higher temperatures. For example, the ventilation system can be preset such that ventilation is started automatically at 32 degrees Celcius, for example. The ventilation may then be increased by one step per 0.5 degree temperature increase, for example. This range can be shifted by manual adjustment. For example, if ventilation is already started by manual operation at 28 degrees Celcius, this is memorized by the CPU, which then starts always automatically at 28 degrees Celcius. Only when the battery is taken out and the memory is cleared are the predetermined values reset. It is contemplated that the ventilation system may be preset to operate at other temperatures. In addition, in applications where heating is desired, the ventilation system may be preset such that the ventilation system begins to operate at lower temperatures.

The ventilation system 20 is switched off by simultaneously pressing left button 61 and right button 62 of input device 60. In response, LEDs 63, 64, and 65 each flash in the reverse order of switching them on, i.e. from right to left in FIG. 7. In an alternative embodiment, ventilation system 20 is automatically switched off when the shoe is taken off, as described above in connection with proximity sensors/switches.

Input device 60 can also be used to indicate and monitor charging of the battery 22, as described above. In one embodiment, LEDs 63, 64, and 65 blink during charging of the battery. When charging is finished, the LEDs 63, 64, and 65 flash continuously.

In an alternative embodiment, a digital display having 7 or 14 LEDs, for example, is used in order to display the ventilation level by digits.

The described control is merely one exemplary embodiment. Using the same operating controls 61-65 other control algorithms can be realized. Additionally or alternatively, other operating controls can be used, for example capacitive or touch-sensitive elements. For example, the proximity switches described above can be used as buttons 61 and 62 of the input device 60. It is further conceivable that the ventilation system 20 is controlled by voice input.

The described input device 60 contributes substantially to a desired foot climate since it allows an adjustment of the ventilation system 20 to the wishes of the user at any time. This is not possible by exclusively automatic control, as described in the prior art.

In a preferred embodiment the input device 60 simultaneously controls a control unit of a second shoe. This can be realized, for example, by an RF module inside the ventilation system 20 and a corresponding RF module in the second shoe. This avoids the need for an input of adjustments for the second shoe. In this case, the second shoe may be provided without an input device.

In a further embodiment, ventilation system 20 is controlled by a portable electronic device (mobile telephone, PDA, MP3 player, wrist watch, etc.). Because runners and walkers frequently carry such a portable electronic device, ventilation system 20 can be controlled in a particularly simple and comfortable way in this manner. For this purpose, many different possibilities of unidirectional or bi-directional control and/or communication are conceivable. For example, control of the ventilation system is performed by the portable electronic device when the ventilation system is in the manual mode. In the automatic mode the respective states of the ventilation system 20 could be transmitted to the portable electronic device and could be communicated visually or acoustically, as described below.

Control of ventilation system 20 can be achieved by low power wireless transmission which is present in the portable electronic device, for example BlueTooth® or BlueRobin (see, e.g., www.bmwireless.com). Ventilation system 20 is equipped with the same RF module as the portable electronic device and gets adjusted via a user interface of the portable electronic device. This may lead to substantially extended possibilities to adjust and monitor the shoe as compared to the input device described above. For example, measured values of the sensors such as temperature and moisture and the power state of the battery can be indicated or even output acoustically. Furthermore, not only measured values could be visually and/or acoustically communicated to the user but also training instructions derived from the measuring values.

This connection of the ventilation system 20 with a portable electronic device leads to further possibilities for long-term monitoring of the activities of the user of the shoe. For example, the control unit may register a time period in which a shoe is worn, split according to passive phases and active phases. This data may be transmitted too and stored in the portable electronic device where it can be summarized as training profiles. Further, other quantities from appropriate sensors may be acquired, evaluated, stored and transmitted to the portable electronic device. Examples are step length, number of steps, pace, speed, and/or distance. The acquired and evaluated data could be transmitted to a PC and to other electronic devices for further processing, including transmission over the Internet.

FIG. 8 shows a sock 70 for use together with a shoe and ventilation system described above. The bottom side of the sock is shown facing upward in FIG. 8. The sock 70 comprises areas 71 and 72 which have a different fabric structure and/or different materials. In particular, in area 72, sock 70 is designed such that it is provides good air permeability so that it facilitates ventilation of the foot. On the other hand, area 71 has reduced air permeability as compared to area 72 or no air permeability at all. As can also be recognized in FIG. 8, area 72 substantially covers inlet 51 and outlet 52 of insole 50 shown in FIG. 6. Other shapes of area 72 are also conceivable. For example, area 72 could cover only one of inlet 51 or outlet 52, or area 72 could cover the whole sock 70.

In other embodiments of the invention the described control unit with CPU and sensors and/or input device 60 is operated with different ventilation systems or with different arrangements of the ventilator 21 and the air channel 40. For example, the inlet and/or outlet of the air channel can be arranged on the outside of the shoe or in the upper part of the shoe, and the ventilator can be arranged in the upper part of the shoe.

Further, the control unit can also be used without a ventilation system together with a portable electronic device to register the activities of a user of the shoe, as described above. In one example, the control unit is applied to control a module, for example an active damping element, in the sole. Additionally, an appropriate embodiment of an input device and/or a portable electronic device connected to the control unit can be employed, as described above.

As noted elsewhere, these example embodiments have been described for illustrative purposes only, and are not limiting. Other embodiments are possible and are covered by the methods and systems described herein. Such embodiments will be apparent to persons skilled in the relevant art(s) based on the teachings contained herein. Thus, the breadth and scope of the methods and systems described herein should not be limited by any of the above-described exemplary embodiments, but should be defined only in accordance with the following claims and their equivalents.

What is claimed is:

1. An article of footwear, comprising:

a ventilation system with at least one active ventilation element arranged in a midfoot area of the article of footwear; and at least one air channel arranged in a sole area in an interior of the article of footwear comprising:

an inlet arranged in the interior of the article of footwear, configured to suck air out of the interior of the article of footwear; and an outlet arranged in the interior of the article of footwear, configured to subsequently blow air sucked out of the interior of the article of footwear by the inlet back into the interior of the article of footwear, wherein the active ventilation element is arranged such that air is sucked out of the interior of the article of footwear through the inlet and blown into the interior of the article of footwear through the outlet.

2. The article of footwear of claim 1, wherein the inlet of the air channel is arranged in the midfoot area and the outlet of the air channel is arranged in a forefoot area.

3. The article of footwear of claim 1, wherein the article of footwear further comprises an intermediate sole, and said air channel comprises one or more recesses in the intermediate sole.

4. The article of footwear of claim 3, wherein said one or more recesses are arranged in a midfoot area of the intermediate sole.

5. The article of footwear of claim 3, wherein said one or more recesses are arranged in a forefoot area of the intermediate sole.

6. The article of footwear of claim 3, wherein said recesses are arranged in both a midfoot area and a forefoot area of the intermediate sole.

7. The article of footwear of claim 3, further comprising a covering element adapted to cover the one or more recesses and which comprises an opening in a midfoot area of the article of footwear.

8. The article of footwear of claim 3, further comprising a covering element adapted to cover the one or more recesses and which comprises an opening in a forefoot area of the article of footwear.

9. The article of footwear of claim 3, further comprising a covering element adapted to cover the one or more recesses and which comprises an opening in both a midfoot area of the article of footwear and a forefoot area of the article of footwear.

10. The article of footwear of claim 3, wherein the ventilation system is accessible from a side of the intermediate sole.

11. The article of footwear of claim 3, wherein the ventilation system comprises a control unit.

12. The article of footwear of claim 11, wherein the control unit comprises a CPU.

13. The article of footwear of claim 11, wherein the control unit comprises one or more sensors.

14. The article of footwear of claim 11, wherein the control unit comprises a CPU and one or more sensors.

15. The article of footwear of claim 11, wherein the intermediate sole comprises a plurality of layers, and at least a part of the control unit is arranged between two layers of the intermediate sole.

16. The article of footwear of claim 11, wherein the control unit is arranged in a heel area of the article of footwear.

17. The article of footwear of claim 11 further comprising an upper, wherein the control unit is arranged at least in part in the area of the upper of the article of footwear.

18. The article of footwear of claim 13, wherein the sensors include at least one temperature sensor.

19. The article of footwear of claim 13, wherein the sensors include at least one moisture sensor.

20. The article of footwear of claim 13, wherein the sensors include at least one moisture sensor and at least one temperature sensor.

21. The article of footwear of claim 13, wherein the sensors determine a usage state of the shoe.

22. The article of footwear of claim 11, wherein the shoe comprises an input device for the control unit.

23. The article of footwear of claim 11, wherein the control unit comprises an automatic mode.

24. The article of footwear of claim 11, wherein the control unit comprises a manual mode.

25. The article of footwear of claim 11, wherein the control unit comprises an automatic mode and a manual mode.

26. The article of footwear of claim 25, wherein the control unit can be adjusted manually when it is in the automatic mode.

27. The article of footwear of claim 22, wherein the input device is arranged in a heel area of the article of footwear.

28. The article of footwear of claim 22, wherein the input device controls a control unit of another article of footwear.

29. The article of footwear of claim 22 further comprising a portable electronic device, wherein the portable electronic device can display data received from the control unit.

30. The article of footwear of claim 29, wherein the control unit is controlled by the portable electronic device.

31. The article of footwear of claim 29, wherein the control unit, the input device or the portable electronic device can store, display, or output user-specific adjustments.

32. The article of footwear of claim 1 further comprising a power source for the ventilation system and a power-jack, wherein the power source can be charged by the power-jack.

33. The article of footwear of claim 1, wherein the ventilation system is supplied with power by transforming mechanical power into electric power.

34. A ventilation system, comprising:

an article of footwear including at least one active ventilation element arranged in a midfoot area of the footwear, and at least one air channel arranged in a sole area in an interior of the footwear comprising: an inlet arranged in the interior of the article of footwear, configured to suck air out of the interior of the article of footwear, and an outlet arranged in the interior of the article of footwear, configured to subsequently blow air sucked out of the interior of the article of footwear by the inlet back into the interior of the article of footwear; and a sock having a first area and a second area, wherein the active ventilation element is arranged such that air is sucked out of the interior of the footwear through the inlet and blown into the interior of the footwear through the outlet, and wherein the second area of said sock is formed to at least partially overlap the air channel when worn on the foot of a user of the footwear.

35. The ventilation system of claim 34, wherein the fabric structure of the second area of the sock is different from the fabric structure of the first area of the sock.

36. The ventilation system of claim 34, wherein the second area of the sock comprises a different material than the first area of the sock.

37. The ventilation system of claim 34, wherein the second area of the sock is more permeable than the first area of the sock.

38. The article of footwear of claim 1, further comprising:

a control unit operatively connected to said active ventilation element, wherein said control unit operates said active ventilation element at a first selected level during a first period and at a second selected level during a second period.

39. The ventilation system of claim 38, wherein the first period comprises a period wherein the article of footwear is off the ground.

40. The ventilation system of claim 39, wherein the second period comprises a period wherein the article of footwear is in contact with the ground.

* * * * *